United States Patent [19]

Allen et al.

[11] Patent Number: 4,458,828

[45] Date of Patent: Jul. 10, 1984

[54] ELECTRONIC RESET CIRCUIT FOR A FLUID DISPENSER

[76] Inventors: Ollie J. Allen, 4037 High Point Rd., Ellicott City, Md. 21043; Kelly M. Allen, 1015 Caren Dr., Eldersburg, Md. 21784

[21] Appl. No.: 299,669

[22] Filed: Sep. 8, 1981

[51] Int. Cl.[3] ..... B67D 5/26

[52] U.S. Cl. ..... 222/33; 222/35

[58] Field of Search ..... 222/23, 32, 33, 34, 222/35, 36, 37; 364/465

[56] References Cited

U.S. PATENT DOCUMENTS 3,367,537 2/1968 Robinson et al. ..... 222/33

3,852,577 12/1974 Moon et al. ..... 222/35 X 3,990,607 11/1976 Montgomery ..... 222/33

*Primary Examiner*—Joseph J. Rolla

*Assistant Examiner*—Charles C. Compton

*Attorney, Agent, or Firm*—Trexler, Bushnell & Wolters, Ltd.

[57] ABSTRACT

An electronic reset circuit is provided for a fluid dispenser of the type including a fluid pump and a meter, wherein upon deactivation of the fluid pump, the meter must be reset in order to reactivate the pump and a resetting device normally actuatable for accomplishing meter resetting. The electronic reset circuit comprises a reset control switch actuatable only by a fluid dispenser attendant and an electronic circuit coupled with the resetting device and with the reset control switch for preventing resetting of the meter in response to normal actuation of the resetting device until actuation of the reset control switch by the attendant.

12 Claims, 4 Drawing Figures

Fig. 1.
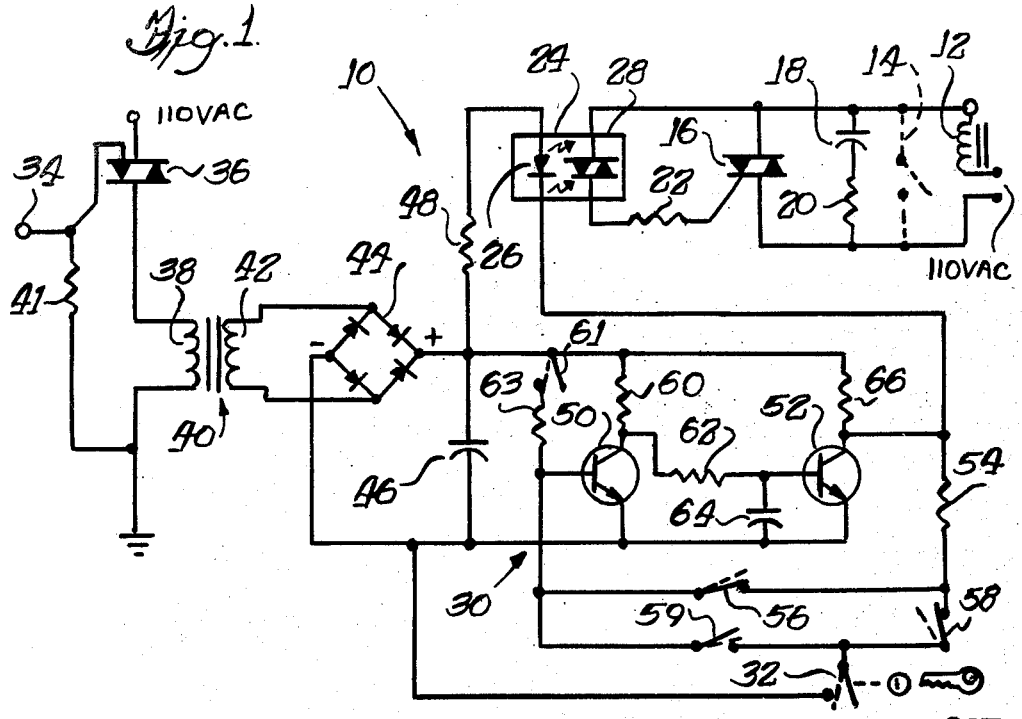
Fig. 2.
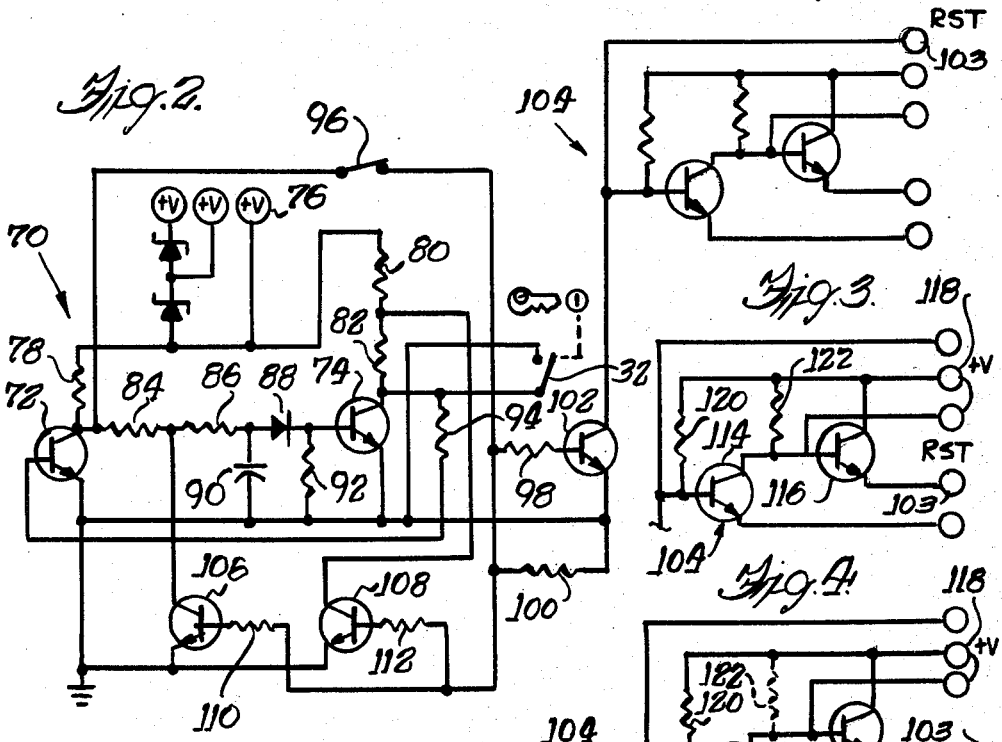
Fig. 3.
Fig. 4.
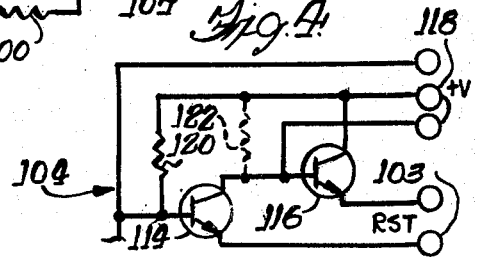

ELECTRONIC RESET CIRCUIT FOR A FLUID DISPENSER

BACKGROUND OF THE INVENTION

The present invention is directed generally to electronic control circuits for fluid dispensers and more particularly to an electronic reset circuit for resetting the meter of an automotive fuel pump.

Conventional automotive fuel dispensers or fuel pumps generally include a fuel pump and a meter for indicating the amount of fuel dispensed and the dollar amount of the transaction. The meter component is generally referred to as a "computer", although it may be a mechanically operated device as well as an electronically operated device. In most installations, the meter or computer must be reset to zero following shutoff of the fuel pump at the end of a transaction, before the fuel pump may be restarted for a subsequent transaction. In "full service" installations, this resetting presents little problem since the pump is always operated only by an attendant, rather than by the customer.

However, with the increasing popularity of "self service" installations, it is important to maintain control of the resetting of the meter to prevent a second customer from using the pump before the first customer has paid the indicated amount. In this regard it is not unheard of for a single customer to pump a given amount of fuel, reset the meter to zero and begin pumping again, thus paying only for the portion of fuel pumped after resetting.

The prior art has provided mechanical interlocking devices, however, problems have arisen with this approach. Commonly, such a mechanical interlock comprises a bar or like mechanical stop component which provides a stop for the pump handle and comes into play each time the pump handle is moved from its "on" position to its "off" position, preventing the handle from being again moved to its "on" position until an attendant has released the mechanical interlock. However, many customers are unaware of the existence of this mechanical interlock and hence are inclined to utilize an undue amount of force in an attempt to move the pump handle to its "on" position. This has frequently resulted in damage to either the mechanical interlock system or the pump handle itself, necessitating shutdown of the affected pump and relatively expensive and time-consuming repair.

The present invention therefore proposes an electronic reset control arrangement which avoids the problems encountered with the mechanical interlocking system. With the electronic reset system of the invention, the pump handle is at all times free to move, although movement thereof to the "on" position in the absence of actuation by the attendant of the electronic resetting system of the invention, will not reset the meter or permit fuel to be pumped. Hence, the customer may actuate the pump handle any number of times in the normal fashion in attempting to obtain service without causing any mechanical damage to the pump.

Providing an electronic resetting arrangement has heretofore presented at least two problems which the present invention solves. Firstly, the known hazards of using electrical circuits within or near areas of a gasoline dispenser wherein volatile fumes may be present must be overcome. Secondly, an electronic reset device should be capable of installation upon fuel dispensers of a number of different types, while remaining relatively easy to install and requiring little or no modification to the fuel pump or dispenser itself.

OBJECTS AND SUMMARY OF THE INVENTION

Accordingly, it is a general object of the invention to provide a novel and improved electronic reset circuit for a fluid dispenser.

A more specific object is to provide an electronic reset circuit for a fuel pump of the type utilized in "self-service" installations.

A further object is to provide an electronic reset circuit of the foregoing type which operates at relatively low voltages and currents so as to be suitable for use in conjunction with a gasoline or similar fuel dispenser.

Yet another object is to provide an electronic reset circuit in accordance with the foregoing objects which is readily adapted to operate with any of a number of different types of fuel dispensers with little or no modification to the dispenser.

Still another object is to provide an electronic reset circuit of the foregoing type which is relatively simple and inexpensive in its design and construction and yet highly reliable in operation.

Briefly and in accordance with the foregoing objects, an electronic reset circuit is provided for a fluid dispenser of the type including a fluid pump and meter means, wherein upon deactivation of said fluid pump, said meter means must be reset in order to reactivate said pump and resetting means normally actuatable for accomplishing said meter means resetting. The electronic reset circuit comprises reset control switch means actuatable only by a fluid dispenser attendant and circuit means coupled with said resetting means and with said reset control switch means for preventing resetting of said meter means in response to normal actuation of said resetting means until actuation of said reset control switch means by the attendant.

BRIEF DESCRIPTION OF THE DRAWINGS

The foregoing, as well as other objects, features and advantages of the invention will be better understood upon reading the following detailed description of the illustrated embodiments, together with reference to the drawings, wherein:

FIG. 1 is a schematic circuit diagram of a first embodiment of an electronic reset circuit in accordance with the invention;

FIG. 2 is a schematic circuit diagram of a second embodiment of an electronic reset circuit in accordance with the invention;

FIG. 3 is a schematic circuit diagram of one embodiment of a portion of the circuit of FIG. 2; and FIG. 4 is a schematic circuit diagram of a second embodiment of a portion of the circuit of FIG. 2.

DETAILED DESCRIPTION OF THE ILLUSTRATED EMBODIMENT

Referring now to the drawings, and initially to FIG. 1, one form of an electronic reset circuit in accordance with the invention is indicated generally by the reference numeral 10. This circuit 10 is adapted for use with either of two types of known fuel dispensers. As the fuel dispensers themselves form no part of the invention, they will not be illustrated and described herein.

Suffice it to say that a first type of fuel dispenser utilizes an electromechanical metering device or "computer". This electromechanical computer is provided with a number of conventional number wheels for counting both quantity and the corresponding price of fuel pumped. The computer or meter is provided with a suitable electrical motor for resetting to zero at the end of a transaction, or just before a subsequent transaction. In this regard, a conventional pump handle is provided which, when actuated to its "on" position, initially resets the meter or computer to zero and only thereafter permits pump operation for the dispensing of fuel.

In FIG. 1, this motor is indicated schematically by a coil 12. As illustrated in FIG. 1, a suitable switch 14 indicated in phantom line schematically represents a switch component associated with the pump handle for completing the circuit to the motor for resetting purposes. However, this switch 14 is disabled, for example, by disconnecting one of the leads therefrom to the motor 12, and the circuit 10 is wired in circuit with this motor 12 to accomplish the reset function in accordance with the invention.

To this end, a conventional 110 volt AC power source, as well as the appropriate terminals from the motor 12, are available within a circuit box already provided on a conventional fuel dispenser. Accordingly, terminals from the switch 14 may be located for disabling thereof and like terminals from the motor 12 and the 110 volt AC supply may be located readily for interconnection of the circuit 10 of the invention therewith as schematically illustrated in FIG. 1.

The circuit 10 includes a power circuit for the motor 12, which comprises a conventional triac switching device 16 coupled essentially in series between the motor 12 and the AC line. A capacitor 18 and resistor 20 are wired in conventional fashion in parallel circuit with the triac 16. The gate electrode of the triac 16 is energized by way of a suitable resistor 22 from an opto-isolator component 24. In the illustrated embodiment, the opto-isolator component 24 comprises a light emitting diode (LED) 26 and a photo-responsive or light activated triac 28. Accordingly, when the LED 26 is energized, the triac 28 is activated to provide a suitable signal level to the gate of the triac 16, through the resistor 22, causing current flow through the motor 12 to reset the computer or meter. The other electrode of the triac 28 is coupled to the junction of the triac 16 with the motor 12.

The LED 26 is in turn controlled by an electronic, and preferably transistorized, circuit portion designated generally by the reference numeral 30. Operation of this circuit 30 is in turn controlled by a switch 32 which is preferably accessible only to a pump attendant. In this regard, the switch 32 may be of a key operated type, whereby it may be located upon the pump itself, but only actuated by means of a suitable key in the possession of the attendant, as schematically illustrated in FIG. 1.

The meter or computer of the type of pump which utilizes the motor 12 also provides a 110 volt AC output at a terminal 34 which is generally referred to as an "in use" signal, when the computer has been reset by the motor 12. In this regard, a second triac 36 has its gate electrode coupled to this terminal 34 and has its other electrodes coupled in series with the 110 volt AC line and the primary coil 38 of a suitable transformer 40. A suitable resistor 41 is also provided between the terminal 34 and the ground or low side of the 110 volt AC line. The secondary coil 42 of the transformer 40 feeds a full-wave rectifier 44 which supplies a suitable rectified DC voltage for the electronic circuit 30. In this regard, a suitable smoothing capacitor 46 is also provided at the output side of the full-wave rectifier 44.

It will be noted that the rectified DC voltage at the output of the full-wave rectifier 44 also feeds the anode of the LED 26 by way of a suitable resistor 48. Hence, in order to energize or light the LED 26 the circuit must be completed to the cathode thereof by way of the electronic switching circuit 30. In the illustrated embodiment, this circuit 30 includes a first transistor 50 and a second transistor 52. The cathode electrode of the LED 26 is coupled with the collector electrode of the transistor 52 and is also coupled with the base electrode of the transistor 50 by way of a series coupled resistor 54 and a switch 56. This switch 56 is held closed at all times when the circuits of the invention are to be utilized in conjunction with a motor reset type computer or meter of the type briefly described above. The junction of the resistor 54 with the switch 56 also feeds a second switch 58, which, like the switch 56, is always held closed when the circuit of the invention is used with the motor reset type of pump described. This second switch 58 feeds the attendant-accessible and preferably key-operated switch 32, whose other side is coupled with the ground or low side of the full-wave rectifier 44. The switch 58 also feeds a second switch 59, whose other side is coupled to the base electrode of the transistor 50. However, this latter switch 59 remains open at all times when this circuit is used to control the motor reset dispenser.

The collector electrode of the transistor 50 receives a suitable bias current from the positive side of the rectifier circuit 44 by way of a suitable resistor 60. Moreover, this collector electrode is also coupled with the base electrode of the second transistor 52 by way of a further resistor 62. A suitable capacitor 64 is provided from the base electrode of the transistor 52 to the ground or low side of the rectifier bridge 44. Suitable biasing current to the collector electrode of the transistor 52 is provided by a further suitable resistor 66. A final switch 61 from the positive DC side of rectifier bridge 44 is coupled by way of a resistor 63 to the base electrode of the transistor 50. However, this switch 61 remains open at all times when the circuit is used with the motor reset arrangement described.

In operation, it will be appreciated that the transistors 50 and 52 and cooperating circuitry just described operate essentially as a "flip-flop". When the computer or meter is at zero, or in its reset condition, there is no voltage or signal level at the terminal 34. Hence, the resistor 42 holds the gate of the triac 36 essentially at ground, whereby the triac provides 110 volts AC to the transformer 40, thereby providing DC power by way of the rectifier bridge 44. Hence, a suitable base current is provided to the transistor 50 by way of the resistors 66 and 54, whereby the transistor 50 goes into a saturated or "on" condition.

Due to the RC delay provided by resistor 62 and capacitor 64, base current to the second transistor 52 is somewhat delayed. The saturation condition of transistor 50 will pull its collector and the base electrode of the transistor 52 essentially to ground. Accordingly, the collector electrode of the transistor 52 will now be essentially at the level of the power supply, whereby the cathode and anode electrodes of the LED 26 will be essentially at the same voltage and the triac 28 and hence triac 16 and motor 12 will remain inactive. With the meter already reset and the circuit 10 in this condition, the desired amount of fuel may be pumped.

When the pump handle is again returned to its "off" position, subsequent actuation of the pump handle to its "on" condition will not result in resetting of the meter, as no current is supplied to the motor 12. In order to reset the computer or meter and thereby allow pumping of fuel for a subsequent transaction, the attendant-accessible and preferably key-operated switch 32 is momentarily closed and then opened.

When the switch 32 is closed, the base of transistor 50 is momentarily grounded, whereby transistor 50 goes out of saturation and transistor 52 saturates due to the current supplied to its base by way of resistors 60 and 62. Hence, the collector electrode of the transistor 52 will now be at or near circuit ground, thereby placing a low voltage or ground condition on the cathode of LED 26. Hence, current will flow through the LED 26 by way of the resistor 48, which will in turn energize the light-responsive triac 28 and fire triac 16, thus providing current flow through the motor 12 for resetting purposes.

When the reset motor has reset the computer or meter, the circuit point 34 will receive a 110 volt AC "in use" signal, which will deactivate the triac 36, resulting in a no-voltage condition at the output of the rectifier bridge 44. It will be recognized that this no-voltage condition will cause the LED 26 to de-energize and the triac 16 to open, removing voltage from the reset motor 12. When the transaction is complete, operation of the pump handle back to the "off" position removes the 110 volts AC from the terminal 34, so that the above operation may be repeated.

The circuit of FIG. 1 may also be utilized with a second type of pump which utilizes a mechanical reset arrangement. In such pumps, a spring-loaded reset mechanism for the mechanical wheels of the calculator or meter is normally tripped by actuation of a mechanical lever mounted on the pump and accessible to the user. When the circuit of FIG. 1 is utilized in conjunction with this mechanical trip mechanism, the lever may be disabled and the coil 12 will comprise a solenoid coil for accomplishing tripping of the spring-loaded reset mechanism. In other respects, the power circuit to the coil 12, including the triac 16 and opto-isolator 24, remains the same.

However, in this type of reset arrangement no electrical signal is provided to the terminal 34 at any time, whereby the 110 volts AC is continuously passed by the triac 36 to provide a rectified DC voltage at the output of the full-wave rectifier 44. To accomplish resetting by way of the "trip" solenoid 12, the four switches 56, 58, 59 and 61 are set to positions opposite those utilized for energizing the motor-driven reset mechanism described above. Hence, the switches 56 and 58 are both placed in their open circuit condition while the switches 59 and 61 are placed in a closed circuit condition, as indicated in dashed line.

In operation, when the attendant-accessible key-operated switch 32 is closed, the base of transistor 50 is grounded through the closed switch 59 and closed switch 32. Accordingly, base current is fed to the base of transistor 52 which goes into saturation pulling the cathode of the LED 26 to ground, hence completing the circuit therethrough. Accordingly, the "trip" solenoid 12 is energized by way of the associated circuitry including triacs 28 and 16, in the same fashion as the motor was energized as described above. In this mode of operation the computer or meter reset includes a mechanical lockout to the fluid pump so that the flip-flop action of the transistors 50 and 52 is not utilized.

It will be appreciated that the circuit of FIG. 1 may be utilized for "full service operation", wherein the attendant operates the pump, without the necessity of utilizing the electronic reset feature thereof by the simple expedient of leaving the switch 32 closed at all times. In this mode of operation, resetting will automatically take place following each transaction.

Reference is next invited to FIG. 2, wherein a circuit for accomplishing resetting of an electronic meter or computer is illustrated. In fuel pumps provided with such an electronic meter or computer, resetting is also required to permit operation of the fuel pump. However, this resetting is accomplished merely by providing a suitable electrical signal level to the meter or computer. This signal level may be a ground or common condition or given DC level to a given reset terminal of the electronic computer or meter, or may comprise a change in signal level from a positive DC voltage to ground, or vice-versa. In order to provide the proper signal level for various types of electronic computers or metering components, alternative forms of a signal output portion of the circuit of FIG. 2 are illustrated in FIG. 3 and FIG. 4, respectively.

Referring initially to FIG. 2, the resetting circuit is designated generally by the reference numeral 70. This circuit 70 includes a first transistor 72 and a second transistor 74 wired to function essentially as a flip-flop circuit, in similar fashion to the transistors 50 and 52 of the circuit 30 of FIG. 1. To this end, suitable biasing signals are provided at the respective collector electrodes of the transistors 72, 74 from a suitable positive DC voltage supply 76, by way of resistors 78 and 80, 82, respectively. The emitter electrodes of both transistors 72 and 74 are coupled with the DC common line or circuit ground. The collector electrode of the transistor 72 feeds the base electrode of the transistor 74 by way of a series coupled circuit comprising resistors 84 and 86 and a diode 88. Intermediate the resistor 86 and diode 88 a suitable capacitor 90 is provided to ground. At the base electrode of the transistor 74 a suitable resistor 92 is provided running to ground. The collector electrode of the transistor 74 feeds the base electrode of the transistor 72 by way of a suitable series-coupled resistor 94.

From the foregoing, the basic flip-flop action of the trahsistors 72 and 74, coupled in circuit as described, will be appreciated. The attendant-accessible, and preferably key-operated switch 32 in the circuit of FIG. 2, is coupled intermediate the collector electrode of the transistor 74 and circuit ground. An additional switch 96 comprises a switch normally actuated by operation of the pump handle for accomplishing resetting of the electronic computer or meter. This switch 96 is removed from its normal circuit configuration within the computer or meter circuit and rewired into a series circuit from the collector electrode of the transistor 72 to one side of each of a pair of resistors 98 and 100. The opposite side of the resistor 100 is tied to circuit ground, while the opposite side of the resistor 98 is tied to the base electrode of a further transistor 102 which is utilized as an electronic switch. The emitter electrode of the transistor 102 is fed to circuit ground while the collector electrode thereof feeds both the computer reset input 103 and a further electronic switching circuit designated generally by the reference numeral 104.

Completing the circuit associated with the flip-flop action of the transistors 72 and 74 are a pair of further transistors 106, 108, both of which are in a grounded emitter configuration. The first transistor 106 has its collector electrode tied to the junction of the resistors 84 and 86 while the transistor 108 has its collector electrode tied to the junction of the resistors 80 and 82. The base electrodes of these transistors 106 and 108 are fed from the junction of the resistors 98 and 100 by way of respective series-coupled resistors 110 and 112.

In operation, when the circuit is first powered up, transistor 72 saturates through resistor 78 due to the base current received by way of resistors 80, 82 and 94. The RC delay provided by the resistors 84, 86 and capacitor 90 delays base current to transistor 74, to avoid saturation of transistor 74. Accordingly, transistor 72 pulls the base electrode of transistor 74 low due to the offset provided by the diode 88, which also prevents any low voltage spikes from reaching the base of transistor 74. With transistor 72 in saturation, the switch 96 receives no current and remains in an inactive condition, regardless of actuation thereof via operation of the pump handle. Moreover, the transistor 102 receives no base current and hence the reset line 103 remains in an open circuit or inactive condition. In this first embodiment, the switching circuit 104 is not utilized, the computer reset input 103 (RST) receiving its signal level directly from the collector electrode of the transistor 102. This circuit arrangement is suitable for an electronic computer or metering device which is responsive to a circuit ground or common condition on its reset input for accomplishing resetting.

In order to cause a DC common or ground condition for resetting at the input 103, the attendant-accessible, key-operated switch 32 must be actuated to its closed condition. When this is done, the collector electrode of transistor 74 is grounded through the switch 32, and at the same time, the base electrode of transistor 72 becomes coupled to ground by way of resistor 94 and the switch 32. Hence, transistor 72 goes out of saturation permitting current to flow through resistor 78 to the switch 96. At the same time, base current is permitted to flow through resistors 84 and 86 and diode 88 to the base electrode of the transistor 74, while also charging the capacitor 90. When the attendant-accessible, key-operated switch 32 is opened, it being understood that only a momentary closing thereof is necessary, the ground condition is removed from the collector electrode of the transistor 74. However, this collector electrode remains essentially at circuit ground since the base current has driven transistor 74 into saturation. Hence, the base electrode of transistor 72 is also held essentially at ground, permitting current flow to continue through the resistor 78 to the pump handle actuated switch 96.

Accordingly, the pump handle actuated switch 96 is now in an active condition and closure thereof will accomplish resetting of the pump computer or meter and subsequent actuation of the fuel pump in the normal fashion. In this latter regard, closing the switch 96 will provide base current to the transistor 102 by way of the resistor 98. With transistor 102 in saturation the reset input 103 will be pulled to a circuit ground or DC common level, accomplishing resetting of the electronic computer or meter.

Closure of the switch 96 also provides base current to respective transistors 106 and 108 by way of the respective resistors 110 and 112 causing these latter transistors 106 and 108 to go into saturation. Transistor 106 pulls the junction of resistors 84 and 86 to ground, discharging capacitor 90, while the transistor 108 pulls the junction of resistors 80 and 82 to ground, hence grounding the collector of transistor 74 and the base of transistor 72. Hence, the "flip-flop" is in an "off" state wherein both transistors 72 and 74 are in an open circuit condition, and this state is maintained for so long as the switch 96 remains closed.

When the switch 96 is opened, current is removed from the base electrode of the transistor 102, hence removing the DC common level at the reset terminal 103. The transistors 106 and 108 are also opened which causes resetting of the flip-flop to its first state. In this regard, removing of the ground condition from the junction of transistors 80 and 82 again permits base current to flow therethrough, and by way of resistor 94 to the base electrode of transistor 72, which again goes into saturation removing current from the switch 96 and from the base electrode of transistor 74, in the same fashion as described above. The time delay of the RC circuit comprising resistors 84, 86 and 90 is again effective due to the removal of the ground condition from the junction of the resistors 84 and 86.

The circuit of FIG. 2 may also be utilized to permit "full service" operation, wherein the attendant is always present and operating the fuel pump. In this regard, the attendant may leave the switch 32 closed at all times, which causes the "flip-flop" comprising transistors 72 and 74 and associated circuit to be in its second state at all times, wherein current is provided to the switch 96.

Referring now to FIG. 3 and FIG. 4, the switching circuit 104 comes into play in conjunction with the electronic computers or metering components requiring signal levels other than a DC common or ground, or alternatively, a change in DC signal level to accomplish resetting.

This switching circuit 104 comprises a first transistor 114 and a second transistor 116. The base electrode of the transistor 114 is coupled with the collector electrode of the transistor 102, while the base electrode of the transistor 116 is fed from the collector electrode of the transistor 114. The base electrodes of both transistors 114 and 116 are coupled to a terminal 118 by way of respective resistors 120, 122. In the embodiment of FIG. 3, the emitter electrode of the transistor 116 is coupled to the reset (RST) input 103 of the computer and the emitter electrode of the transistor 114 is tied to ground. Additionally, a suitable positive DC voltage is coupled to the terminal 118 and also directly to the collector electrode of the transistor 114, as indicated by a jumper wire from the terminal 118.

The operation of the circuit 70 for driving the switching transistor 102 is identical to that described above. When the transistor 102 is not saturated, the DC voltage from terminal 118 feeds base current and collector current to transistor 114. Since the emitter of transistor 114 is tied to circuit ground, it functions as an inverter. Hence, when transistor 102 is not saturated, transistor 114 is saturated by the base current through resistor 120, thereby removing base current from transistor 116 and holding the reset terminal at the emitter electrode thereof in an open circuit condition, and hence inactive state. When the transistor 102 goes into saturation, the inverter effect of transistor 114 causes transistor 116 to act as an emitter follower, feeding a DC voltage level to the reset terminal 103 at its emitter electrode. This circuit of FIG. 3 is therefore suitable for use with a computer requiring a positive DC voltage to reset.

Referring next to FIG. 4, the circuit 104 is modified to remove a DC voltage from the reset terminal, to accomplish resetting of a computer which resets in response to this change or interruption of positive DC voltage. In this embodiment, the reset (RST) terminal 103 is fed from the emitter electrode of the transistor 114, and the resistor 122 is taken out of circuit, whereby it is illustrated in dashed line in FIG. 4. The operation of the circuit 70 and the transistor 102 is identical to that described above. When transistor 102 is not in saturation, DC voltage from the terminal 118, which is again fed directly to the collector electrode of transistor 114 and to its base electrode by way of resistor 120, is fed to the reset terminal 103. In this regard, transistor 114 now acts as an emitter follower. With the positive DC level at the reset terminal, this type of computer will not reset. However, when transistor 102 goes into saturation, the base current is removed from transistor 114, thereby removing the positive DC voltage from the reset terminal 103 at its emitter and accomplishing resetting of the computer.

While the invention has been illustrated hereinabove with reference to preferred embodiments, the invention is not limited thereto. Those skilled in the art may devise various changes, alternatives and modifications upon reading the foregoing description. The invention includes such alternatives, changes and modifications insofar as they fall within the spirit and scope of the appended claims.

The invention is claimed as follows:

1. An electronic reset circuit for a fluid dispenser of the type including a fluid pump and meter means, wherein upon deactivation of said fluid pump said meter means must be reset in order to reactivate said fluid pump, and resetting means including an electrical motor normally actuatable in response to operation of a user accessible switch for resetting said meter, said electronic reset circuit comprising: reset control switch means adcessible only by a fluid dispenser attendant; and current control circuit means coupled with said resetting motor and with said reset control switch means for preventing actuation of said motor to reset said meter means in response to user actuation of said user accessible switch and having a first state wherein current flow is permitted in circuit with said motor and a second state wherein current flow is inhibited in circuit with said motor, said current control circuit means being responsive to said reset control switch means for achieving said first state when said reset control switch means is actuated; said current control circuit means including flip-flop circuit means and electronic switching means responsive to the state of said flip-flop circuit means for producing a predetermined electrical signal upon actuation of the reset control switch means, and second electronic switching means interposed between said first electronic switching means and said motor, said second electronic switching means being responsive to the predetermined electrical signal for respectively allowing and inhibiting the flow of current to said motor.

2. An electronic reset circuit according to claim 1 wherein said current control circuit means is coupled in circuit for disabling normal operation of said user accessible reset switch means and for directly allowing or inhibiting current flow to said reset motor.

3. An electronic reset circuit according to claim 1 wherein said resetting means further includes control signal producing means for producing a control signal in response to resetting of said meter and wherein said current control circuit includes means responsive to said control signal for resetting said flip-flop means.

4. An electronic reset circuit for use with a fluid dispenser of the type including a fluid pump and meter means, wherein upon deactivation of said fluid pump, said meter means must be reset in order to reactivate said fluid pump, and including mechanical resetting means including actuating means normally accessible to a user for mechanically resetting said meter means, said electronic reset circuit comprising: reset control switch means accessible only to a dispenser attendant, electromechanical actuating means coupled with said mechanical resetting means and disabling the normal operation of said user accessible actuating means; electronic switch means coupled intermediate said reset control switch means and said electromechanical means for actuating said electromechanical actuating means only upon actuation of said reset control switch means by said attendant; and second electronic switch means coupled intermediate said first electronic switch means and said electromechanical actuating means and responsive to the state of said first electronic switch means for respectively energizing and de-energizing said electromechanical actuating means.

5. An electronic reset circuit according to claim 4 wherein said electromechanical actuating means comprises a solenoid.

6. An electronic reset circuit for a fluid dispenser of the type including a fluid pump and electronically operated meter means, wherein upon deactivation of said fuel pump said meter means must be reset in order to reactivate said fuel pump and wherein said electronic meter means is responsive to a predetermined electrical signal condition normally provided by a user accessible switch for resetting, said electronic reset circuit comprising: reset control switch means remote from the dispenser and accessible only to a fuel dispenser attendant and electronic circuit means coupled with said meter and with said reset control switch means for permitting production of said predetermined signal condition in response to actuation of said user accessible switch only when said reset control switch means is first actuated by said attendant, said electronic circuit means further including signal control circuit means having a first state wherein said predetermined signal condition is produced and second state wherein said predetermined signal condition is not produced; said signal control circuit means being responsive to said reset control switch means for achieving said first state in response to actuation of said reset control switch means; said signal control circuit means including flip-flop circuit means and electronic switching means responsive to the state of said flip-flop circuit means for allowing or inhibiting production of said predetermined signal condition and second electronic switching means interposed between the first electronic switching means and said meter means and responsive to said first electronic switching means for producing said predetermined signal condition at said meter means.

7. An electronic reset circuit according to claim 6 wherein said flip-flop means is coupled in circuit with said user accessible switch.

8. An electronic reset circuit for a fluid dispenser of the type including a fluid pump, meter means and resetting means, wherein upon deactivation of said fluid pump said meter means must be reset in order to reactivate said pump and wherein said resetting means is normally actuatable by a user accessible control for accomplishing said meter means resetting, said electronic reset circuit comprising: reset control switch means actuatable only by a fluid dispenser attendant and circuit means coupled with said resetting means and with said reset control switch means for normally preventing operation of said resetting means in response to said user accessible control alone, and for permitting operation of said resetting means only upon actuation of said reset control switch means; said resetting means being responsive to a predetermined electrical signal for resetting said meter; and said circuit means further including signal control circuit means having a first state wherein said predetermined electrical signal is produced and a second state wherein said predetermined electrical signal is not produced; said signal control circuit means being responsive to said reset control switch means for achieving said first state in response to actuation of said reset control switch means; said signal control circuit means including flip-flop circuit means and electronic switching means responsive to the state of said flip-flop circuit means for allowing or inhibiting production of said predetermined electrical signal and second electronic switching means interposed between the first electronic switching means and the resetting means and responsive to said first electronic switching means for allowing or inhibiting the passage of said predetermined electrical signal to said resetting means.

9. An electronic reset circuit according to claim 8 wherein said current control circuit means includes third electronic switch means interposed between said second electronic switch means and said resetting means and wherein said second electronic switch means functions as an inverter.

10. An electronic reset circuit according to claim 8 wherein said resetting means further includes a control signal producing means for producing a control signal in response to resetting of said meter means and wherein said circuit means includes means responsive to said control signal for resetting said signal control circuit means to said second state.

11. An electronic reset circuit according to claim 8 wherein said user accessible control comprises switch means normally coupled in circuit with said resetting means and wherein said signal control circuit means is coupled in circuit with said user accessible control for allowing and inhibiting a flow of current thereto.

12. An electronic reset circuit according to claim 8 wherein said user accessible control is disabled and wherein said signal control circuit means is coupled directly with said resetting means.

* * * * *